US011796267B2

(12) United States Patent
Kastrun et al.

(10) Patent No.: US 11,796,267 B2
(45) Date of Patent: Oct. 24, 2023

(54) CARBINE WITH CHARGING HANDLE ASSEMBLY

(71) Applicant: GLOCK TECHNOLOGY GMBH, Ferlach (AT)

(72) Inventors: Mario Kastrun, Maria Rain (AT); Elmar Bilgeri, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/753,678

(22) PCT Filed: Sep. 29, 2020

(86) PCT No.: PCT/EP2020/077192
§ 371 (c)(1),
(2) Date: Mar. 10, 2022

(87) PCT Pub. No.: WO2021/063925
PCT Pub. Date: Apr. 8, 2021

(65) Prior Publication Data

US 2022/0341688 A1 Oct. 27, 2022

(30) Foreign Application Priority Data

Oct. 4, 2019 (EP) ..... 19201448

(51) Int. Cl.
*F41A 3/72* (2006.01)
*F41A 17/38* (2006.01)
*F41A 35/06* (2006.01)

(52) U.S. Cl.
CPC ..... *F41A 3/72* (2013.01); *F41A 17/38* (2013.01); *F41A 35/06* (2013.01)

(58) Field of Classification Search
CPC ..... F41A 3/72; F41A 35/06; F41A 17/38
See application file for complete search history.

(56) References Cited

U.S. PATENT DOCUMENTS 3,323,418 A * 6/1967 Loffler ..... F41A 5/26 89/193
7,231,861 B1 * 6/2007 Gauny ..... F41A 3/72 89/1.4

(Continued)

FOREIGN PATENT DOCUMENTS

DE 1902275 A1 7/1970
DE 3928125 A1 2/1991
WO 2008140833 A1 11/2008

OTHER PUBLICATIONS

EP Search Report Intl. Appl. No. PCT/EP2020/077192, dated Nov. 25, 2020.

*Primary Examiner* — Joshua E Freeman
(74) *Attorney, Agent, or Firm* — Raven Patents, LLC; Anton E. Skaugset

(57) ABSTRACT

Rifles having a weapon median plane, with a barrel with a barrel bore axis, a gas drive, a sliding block, a closing spring unit, and a charging handle assembly arranged in front of the sliding block, where the charging handle has two operating handles pivotally mounted about pivot pins on a slider body, said operating handles being pushed about the pivot pins into their rest position by at least one handle spring. For facilitating the use and especially the forward shift of the charging handle, the slider body is mounted on a carriage which is arranged axially in front of the sliding block and movable in the axial direction.

12 Claims, 7 Drawing Sheets

(56) References Cited

U.S. PATENT DOCUMENTS

| | | | | |
|---|---|---|---|---|
| 7,240,600 | B1 | 7/2007 | Bordson | |
| D590,473 | S * | 4/2009 | Fitzpatrick | F41A 3/72 D22/103 |
| D606,614 | S * | 12/2009 | Fitzpatrick | F41A 3/72 D22/103 |
| 7,798,045 | B1 * | 9/2010 | Fitzpatrick | F41A 21/481 89/1.4 |
| 8,156,854 | B2 | 4/2012 | Brown | |
| 8,468,929 | B2 * | 6/2013 | Larson | F41A 35/06 89/193 |
| 8,561,517 | B2 | 10/2013 | Brown | |
| 8,899,138 | B2 | 12/2014 | Brown | |
| 8,997,620 | B2 * | 4/2015 | Brown | F41A 7/00 89/1.4 |
| 9,109,848 | B2 | 8/2015 | Brown | |
| 9,366,489 | B1 | 6/2016 | Strom | |
| 9,733,030 | B2 | 8/2017 | Daniel | |
| 10,352,635 | B2 * | 7/2019 | Noonan | F41C 23/16 |
| 10,598,451 | B1 * | 3/2020 | Haidu | F41A 3/72 |
| 11,073,350 | B2 * | 7/2021 | Meier | F41A 3/66 |
| 2002/0046642 | A1 * | 4/2002 | Murello | F41A 35/06 89/1.42 |
| 2010/0000396 | A1 * | 1/2010 | Brown | F41A 7/02 89/1.4 |
| 2010/0000400 | A1 * | 1/2010 | Brown | F41A 5/18 42/111 |
| 2011/0083551 | A1 * | 4/2011 | Sirochman | F41A 5/18 89/1.4 |
| 2013/0061737 | A1 * | 3/2013 | Brown | F41A 3/72 89/1.4 |
| 2015/0260468 | A1 * | 9/2015 | Foster | F41A 5/26 89/191.01 |
| 2016/0047614 | A1 * | 2/2016 | Larson, Jr. | F41G 11/003 89/191.01 |
| 2017/0321978 | A1 * | 11/2017 | Brannan | F41A 3/70 |
| 2019/0056189 | A1 * | 2/2019 | Lowe | F41C 27/00 |
| 2019/0154382 | A1 * | 5/2019 | Pizano | F41A 3/72 |
| 2021/0180896 | A1 * | 6/2021 | Noonan | F41A 3/66 |

* cited by examiner

CARBINE WITH CHARGING HANDLE ASSEMBLY

TECHNICAL FIELD

The present disclosure relates to firearms, and more particularly to rifles with a charging handle assembly.

BACKGROUND

Charging handle assemblies, also referred to as cocking slides, are provided for carbines (that is, rifles) in order to be able to load the weapon manually; for example, if there is no cartridge in the chamber and a new magazine was inserted, the bolt carrier assembly is pulled toward the rear by means of the charging handle assembly, thus tensioning the recoil or closing spring. During the closing movement, the cartridge is pulled into the cartridge chamber and the lock is locked. When the recoil spring is tensioned, these operations are usually performed by means of the recoil spring. However, in different cases, it can be necessary to manually move the charging handle assembly forward, for example, in order to push the lock forward in case of jamming when the force of the recoil spring/closing spring is insufficient to close the lock in this manner and to allow for the release of the next shot. For the latter activity, a separate device, which is referred to in the art as "forward assist"; is also provided in many cases, but it is desirable to have a charging handle assembly, which allows for both activities.

Charging handle assemblies should be equally operable for both left-handed and right-handed (ambidextrous) persons, which, in contrast to the past, is being increasingly taken into consideration. A further request is that the charging handle assembly be located in front of the sliding block (further referred as bolt carrier) (on the side of the muzzle) because it is otherwise difficult to operate said charging handle assembly when in the shooting position. Charging handle assemblies that are provided behind the bolt carrier make it necessary for the operator to operate directly in front of his/her face, which is cumbersome and, above all, entails a poor alignment of the arm for the operator.

The charging handle assembly is also not supposed to participate in the normal motion sequence of the bolt carrier and the breech because it increases the mass of the moving parts and makes it necessary to provide stronger springs, thus providing a greater force application by the gas drive, which, in turn, increases the acting forces overall, making the weapon as a whole more unsteady because moving masses are present. Finally, the charging handle assembly is supposed to change the outer contour of the weapon as little as possible and, above all, to have no protruding parts which can lead to hindrances and problems especially in the field.

Numerous proposals are known from the prior art. In the following, the most important ones shall be described briefly, wherein the content of not only the following, but all the English-language documents cited in the description:

U.S. Pat. Nos. 8,156,854 B2, 9,109,848 B2, 9,366,489 B1 8,899,138 B2, 7,240,600 B1, 8,561,517 B2, 9,733,030 B2, shall be incorporated by reference into the content of the present application for all jurisdictions where this is possible.

U.S. Pat. No. 8,156,854 B2 discloses a rifle with a charging lever which, in a first embodiment, can be mounted optionally to the right or left of the barrel on a suitable mechanism, wherein the modification requires a total disassembly of the weapon. For reasons of strength, the modification also requires the provision of a different cover or a different housing because the handle of the charging handle assembly protrudes through a long, slit-shaped recess in the cover. In a variation according to FIGS. 15 et seqq., a symmetrical design with two charging levers is provided. In both cases, the handle acts via a carriage-like component on the gas drive of the weapon, which, when pulled back, is greatly subjected to pressure from at least the force of the recoil spring, if not also from the resistance of contaminations and the like, which, due to the length of said gas drive, requires a significantly more massive design than would be the case without this additional function. In order not to participate in the usual movement during the normal release of shots, the handle engages with a pin in a lateral recess of the mantle of the gas drive only when it is rotated about an axis, thus being in the action position, which results in an unpleasant dynamic situation especially for such an action which is usually carried out with great force, and, as shown particularly in FIGS. 10 and 15 of the document, is highly susceptible to contaminations. Another solution is known from U.S. Pat. No. 8,899,138 B2, wherein the force application does not act on the gas drive, but on a special extension in the lock which thus becomes significantly more massive, with the disadvantages described above. Once again, the handle protrudes through the cover, and even though one drawing indicates that it is possible to provide the cover with two corresponding recesses in order to simplify the modification, for mechanical reasons this is hardly feasible in practice.

DE 39 28 125 A1 discloses a foldable handle as a handle of a charging lever, which it addresses almost exclusively and which is of importance in this case only because it relates to a charging lever that moves with the bolt carrier.

WO2008140833 A1 discloses a charging handle residing over the barrel trunnion when it is in a rest position and mounted so as to allow movement transverse the barrel and the path of the bolt carrier. The charging knobs extend beyond the receiver of the firearm on both sides, which may cause unintended interaction with clothes of the user.

Therefore, there is a need for a charging handle assembly which avoids the described disadvantages at least to the greatest possible extent and has the desired, initially-described properties at least to a great extent. The present disclosure addresses the problem of creating such a charging handle assembly.

SUMMARY

The previously-described problems are solved by the charging handle assembly of the present disclosure, where such a charging handle assembly includes at least three of the following features: The charging handle assembly has two handles rotatable mounted on a slider body (also referred as charging handle assembly body) about pivot pins; the handles are pushed about the pivot pins into their rest position by at least one handle spring; the slider body is mounted on a carriage which is arranged axially in front of the bolt carrier and movable in the axial direction; in the carriage, a catch body is slidably mounted normally to the weapon median plane; the catch body is pushed by a catch spring into its rest position symmetrically to the weapon median plane; in its rest position, a protrusion of the catch body is located axially in front of a weapon-mounted catch; when pivoted from its rest position, each of the handles moves the catch body from its rest position, placing the protrusion next to the catch; in the carriage or the recoil spring unit, a hook is mounted which is pivotable about an axis running normally to the weapon median plane, and which, with its hook, is pushed downwardly under the effect of a hooked spring; upon contact between the carriage and the bolt carrier, the hook engages in a bolt carrier-mounted recess, for example, in a casing of the recoil spring; in the foremost position of the carriage, the hook is pivoted out of the recess by a weapon-mounted control edge against the force of the hooked spring.

Embodiments of the present disclosure, particularly for facilitating the use and especially the forward shift of the charging handle assembly, may be described in the dependent claims. Using keywords, this refers essentially to the following features: the handles have elongated holes for the pivot pins attached to the slider body. In an unfolded position of the handles, the elongated holes run parallel to the running axis; in this position, the handles are pushed toward the rear by the handle springs; when the respective handle in the unfolded position is shifted forward, a section of its contour bears against a mating contour of the slider body and prevents a folding into the rest position.

In one example, the present disclosure is directed to a rifle having a weapon median plane, the rifle comprising a barrel with a barrel bore axis, a gas drive, a bolt carrier, a recoil spring unit, and a charging handle assembly arranged in front of the bolt carrier; where the charging handle assembly has two handles pivotally mounted on a slider body, each handle being pivotally mounted on a pivot pin, and each handle being urged to pivot on its pivot pin into a rest position by at least one handle spring; the slider body is mounted on a carriage that is arranged axially in front of the bolt carrier, and the slider body is movable in the axial direction; and each of the two handles is mounted to its pivot pin by an elongated hole, such that when each handle is in an unfolded position the elongated hole runs parallel to the barrel bore axis, and the handles can be guided along the pivot pins.

BRIEF DESCRIPTION OF THE DRAWINGS

The charging handle assemblies of the present disclosure may be explained in more detail with reference to the accompanying drawings.

FIG. 3A shows a perspective view of the charging handle assembly of FIG. 2 in a partially assembled state; while FIG. 3B shows a side view of the charging handle assembly of FIG. 2 in an assembled state;

DETAILED DESCRIPTION

In the description and claims, the terms "front," "rear," "top," "bottom," etc. are used in the common form and with reference to the object in its normal operating position. This means that in the case of a firearm, the muzzle of the barrel is in the "front," the lock or the carriage is moved toward the "rear" by the explosive gases, etc. "Transverse to a direction" refers essentially to a direction rotated by 90° thereto.

Figure 1:
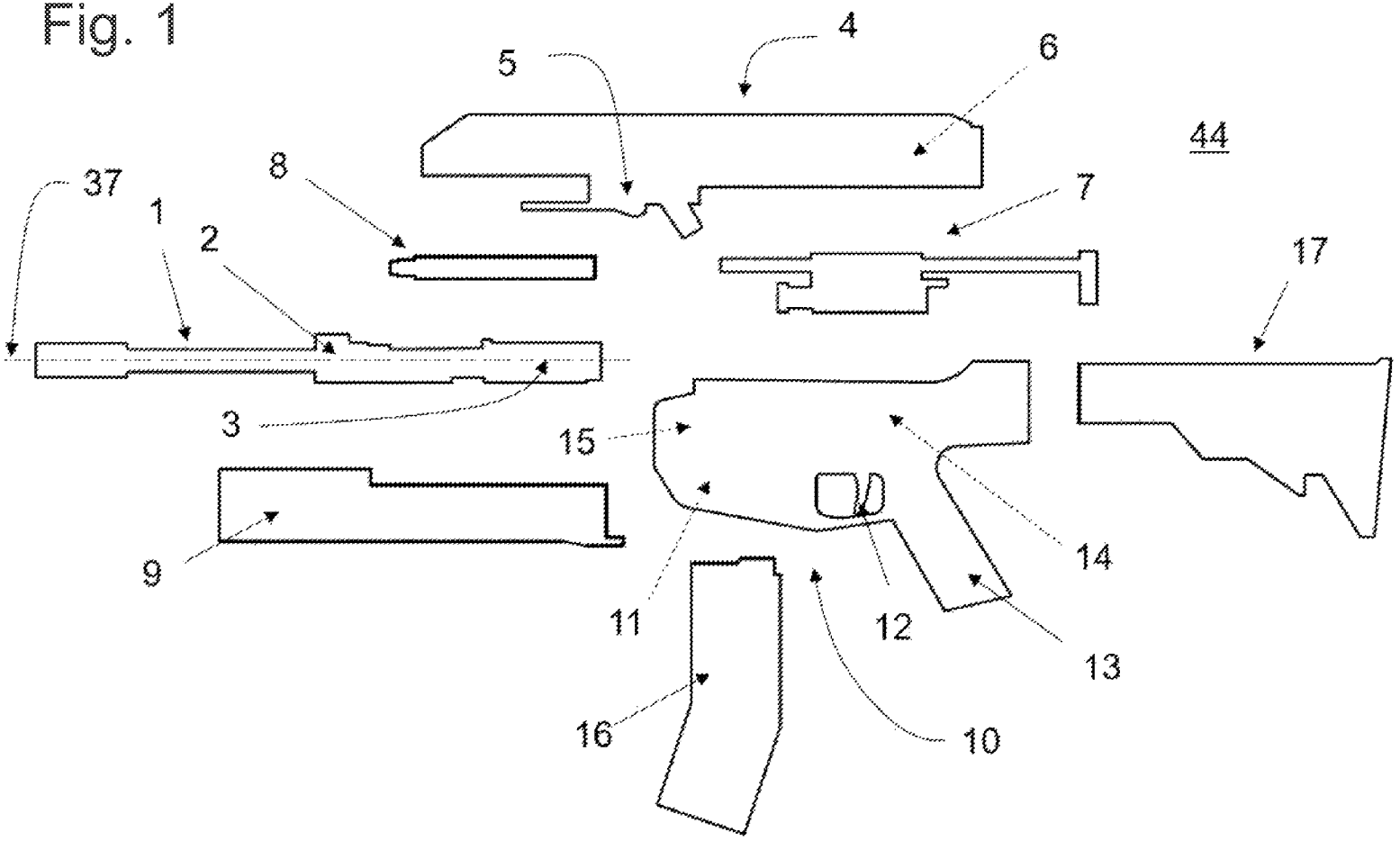
FIG. 1 shows an overview of a weapon with a largely modular design.

As can be seen in FIG. 1, a purely schematic depiction along the weapon median plane 32, a rifle, when viewed from a functional point of view and fully equipped, has, for example, a barrel 1, a gas drive 2, a locking sleeve 3, an upper housing, frequently called upper 4 even outside the USA, a carrier 5, which in turn has guides 6 for a lock 7 and/or a charging handle assembly 8 and/or other functional elements, a front shaft 9, a lower housing, also called lower 10, which in turn comprises a magazine holder 11, a trigger device 12, a handle 13 and a lock catch device 14, a central locking system 15, a magazine 16, and a shaft 17.

Not all of these parts have to be present at all times, or, depending on the application, their design can somewhat deviate, e.g., in case of hunting weapons; however, further parts can also be added, such as mounting elements for riflescopes, laser pointers, and the like. It is also possible that some of the components mentioned are formed inseparably from one another on a more complex component, as is the case of the depicted lower housing or lower 10, and so the drawing represents only one example of a rifle with a highly modular design.

Figure 2:
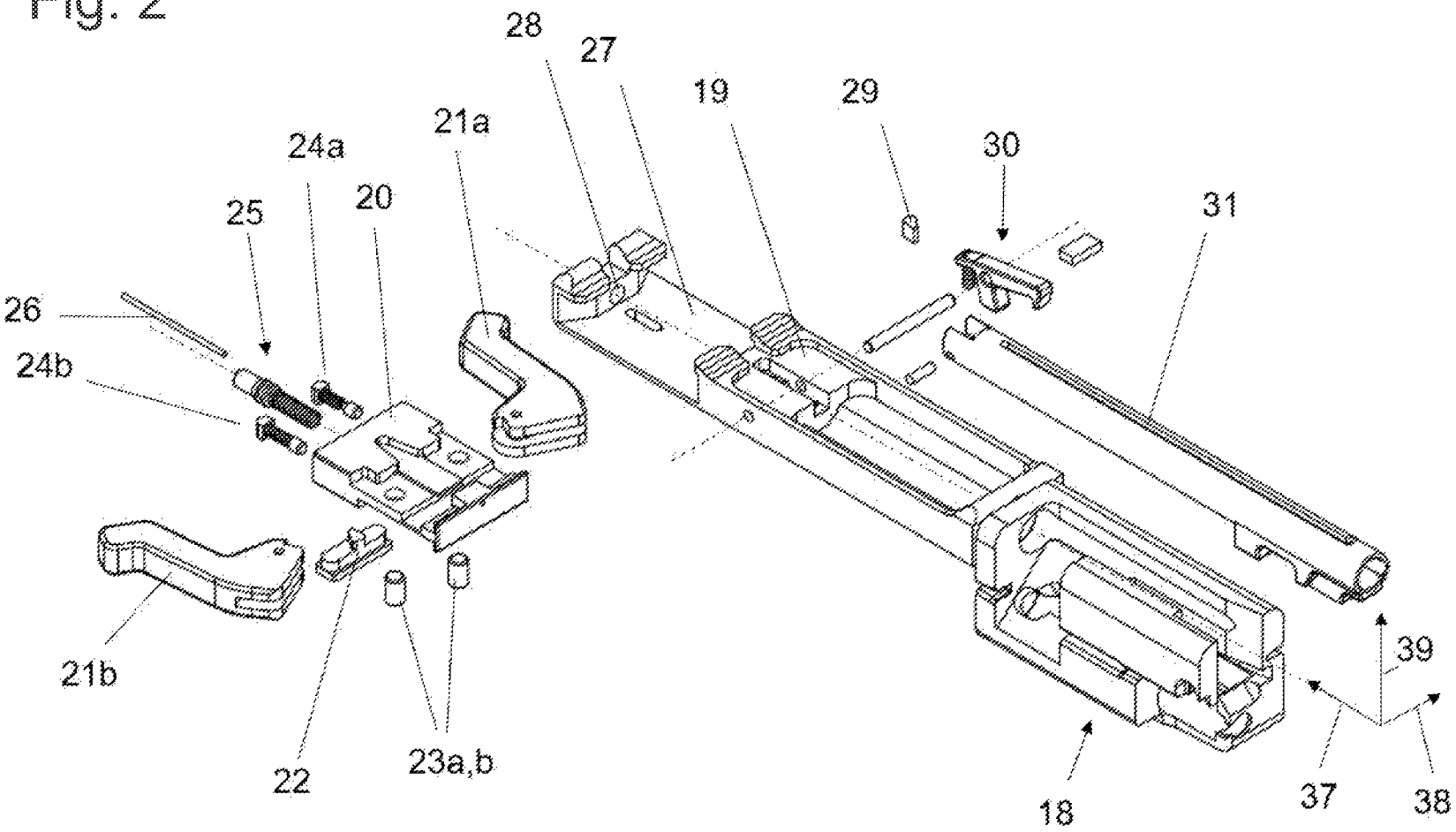
FIG. 2 shows an exploded view of an exemplary charging handle assembly according to the present disclosure.

FIG. 2 shows an exploded view of an embodiment of a charging handle assembly 8 according to the present disclosure. It only shows the parts of the charging handle assembly essential for the weapon, i.e., a bolt carrier 18, a recoil spring unit 31, a charging handle assembly carriage, or carriage 19, for short. In its front area, said carriage has a charging handle assembly seat 27. The charging handle assembly is inserted in said seat, said charging handle assembly having a charging handle assembly body 20, a catch slider 22, slidably in the transverse direction 38 normally to the weapon median plane 32, two pivot pins 23*a, b*, also called "pins," mounted in the body 20, whose axis runs in the vertical direction 39, two handles 21*a, b* which are pivotable mounted about the pivot pins 23*a, b*, and "small parts," such as reset devices 24*a, b*, a locking mechanism 25, and a catch slider spring 16, all running in the direction of the barrel bore axis 37; their exact arrangement and function shall be explained below. Furthermore, the axis system used with the axes or directions 37, 38, and 39, is shown for illustration purposes in FIG. 2. At this point, reference shall already be made to the design, described below, of the two cheeks of the handles 21*a,b* in the mutually facing end region.

Figure 7:
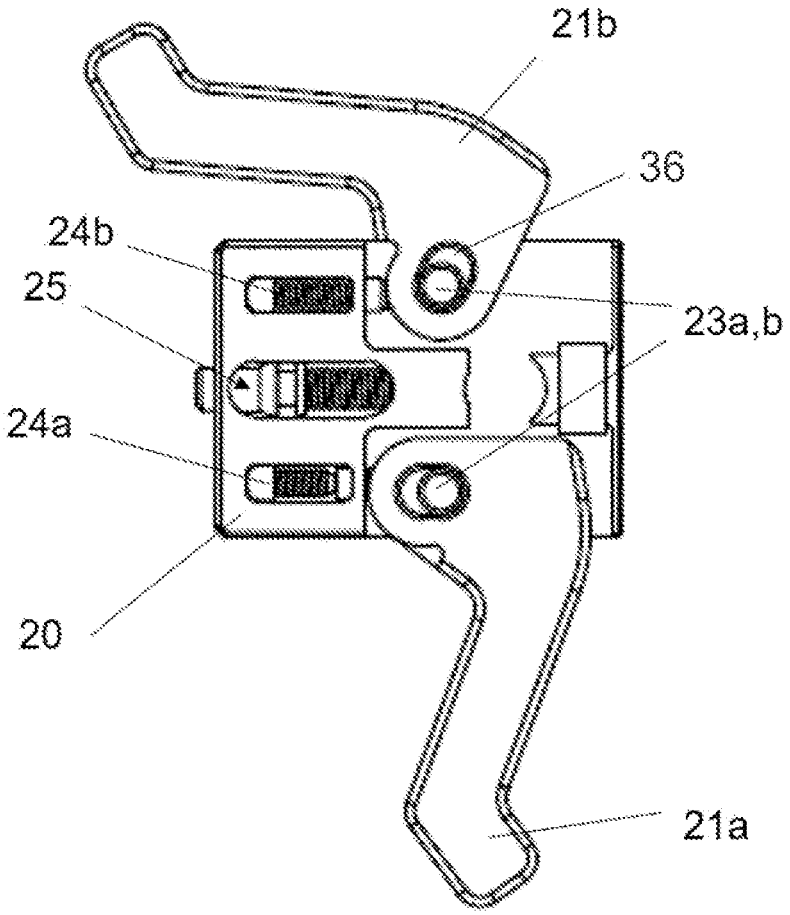
FIG. 7 shows a bottom view of a detail of the disclosed charging handle assembly.

FIG. 7 shows in a bottom view (thus left-right "reversed") of the installation situation of the "small parts" and clarifies their function: In the charging handle assembly body 20, three bores or recesses extending parallel to the direction 37 of the barrel bore axis are provided: One is provided in the weapon median plane 32 for receiving the locking mechanism 25, and two, symmetrically arranged thereto, are provided for receiving the reset devices 24*a, b*. For receiving the pivot pins 23*a, b*, the handles 21*a, b* have elongated holes 36 and are thus not only pivotable about the pivot pins, but also slidably within boundaries. FIG. 7 shows the handle 21*b* for the left hand—which in the drawing is the upper handle because the muzzle of the weapon must be imagined to be to the left of the drawing—in one of the two pressure positions, while the handle 21*a* for the right hand is shown in a fully pivoted actuating position. It is not only pivoted, but also pushed toward the front against the force of a clearly visible reset spring (not denoted with a reference sign) of the reset device 24*a*, as is the case with manual locking, for example, when the recoil spring is too weak, as initially described.

The charging handle assembly can also be used for the locking movement, cf. hereto the sequential images of FIGS. 4B to 4C and FIGS. 5C to 5E which show a top view, in which the temporary interaction of the advance surface 33 of the charging handle 21*a* with the mating surface 35 of the charging handle assembly body 20 is shown by way of example.

The handle 21*b* is only slightly rotated from its rest position and then pressed forward against the force of the reset device 24*b* until the stop engages, and it can then be moved toward the front. In cases with low power requirement, this is quite sufficient, while the position of the handle 21*a* is intended for difficult cases.

When the user releases the handle 21*a* (or also 21*b*), the reset device 24*a, b* pushes it toward the rear until the pivot pin 23*a, b* reaches the end of the associated elongated hole 36.

In a variation, the reset device 24*a* itself, due to the shape of the contours and the positioning of the active axis of the reset device and the axis of the pivot pin, can then rotate the handle 21*a* (FIG. 7, bottom view: clockwise) until it reaches its rest position, in which it is held by the reset device 24*a* in a force-locked manner to bear against the cocking slide body 20; the corresponding recess (without reference sign) is shown in the handle 21*a*.

In another variation, the rotational movement and the rest position of the handles 21*a,b* are ensured by at least one spring provided for this purpose. This can be a coil spring connected to the pivot pin, or a spiral spring common for both handles, which acts from handle to handle.

Since the stop, which specifies the working position for the situation of the handle 21*b*, does not act in the rest position, the handles come even closer to the contour of the weapon.

Figure 6A:
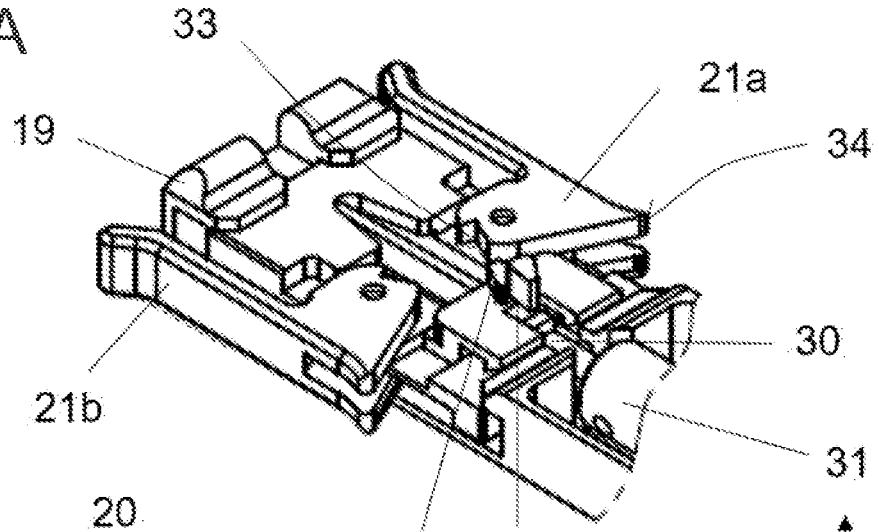
FIGS. 6A and 6B show a perspective view of details of the charging handle assembly of FIGS. 5A-5E.
Figure 6B:
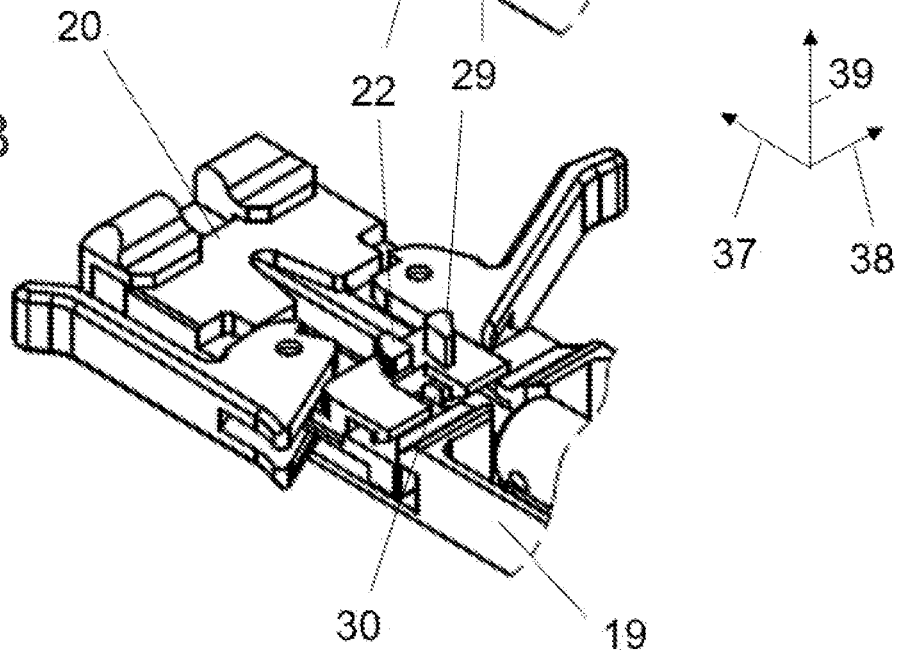

As can be seen from the combination of FIGS. 2 and 3, a recoil spring entraining device, in the following only called entraining device 30, which is rotatable about a transverse pin, is provided on the carriage 19. Alternatively, this entraining device can also be arranged on the charging handle assembly body 20 (as can be seen, e.g., in FIGS. 5 and 6), since both parts move together in the direction 37 of the barrel axis. This entraining device is necessary for manual locking, since the recoil spring unit 31 must be also being brought forward. Such a manual locking is only necessary if the bolt carrier 18, together with the recoil spring unit 31, has not or not entirely reached the front. It is therefore necessary to first move the charging handle assembly all the way back until it bears against the bolt carrier 18, wherein the spring-loaded entraining device 30 engages automatically in the recoil spring device 31; in the depicted embodiment behind a transverse bolt, which is introduced in the front area of said recoil spring device 31.

In knowledge of the present disclosure, a person skilled in the art can easily arrive at other embodiments for replacing the pin, such as an undercut or the like, which can be applied to each of the variations described below. Regardless of the attachment of the entraining device 30 on the carriage 19 or the charging handle assembly body 20, the meshing, as shown, is possible on the recoil spring unit 31 or the bolt carrier 18. Of course, a reverse arrangement (thus a total of four variations) is also possible, and even though the moving mass is increased, said increase, when compared to the prior art, is small, and should thus not be ruled out. In each of these variations, it is possible to align the pivot axis of the entraining device 30 differently than normal to the weapon median plane 32.

After engaging, the now connected entirety of charging handle assembly, recoil spring, and bolt carrier is pushed forward toward the stop (not depicted), and, due to the colliding of the front part of the hook-shaped entraining device 30 with, for example, the underside of a housing-mounted control element 29, the connection is rotated against the force of the spring about the transverse pin until the hook clears the transverse pin. This separation is necessary because during normal operation of the weapon, the charging handle assembly 8 is not supposed to move with the recoil spring unit 31 and the bolt carrier 18.

For this purpose, the housing-mounted control element 29 is provided, which interacts with a catch slider 22 which is slidably in the cocking slide body 20 normally to the weapon median plane 32. This catch slider is under the effect of a catch slider spring 26, which pushes it in a central position to the weapon median plane 32. In this position, the control element 29, in the direction 37 of the barrel axis, is located exactly "behind" a protrusion of the catch slider 22, FIG. 6A, which prevents any movement of the charging handle assembly 8 toward the rear. When turning one of the handles 21*a,b*, the catch slider 22 is shifted laterally against the force of the spring, and its protrusion is no longer aligned with the housing-mounted control element 29, FIG. 6B, the charging handle assembly 8 can be moved, wherein the hook of the entraining device 30 also reaches the working position again. It is possible but not preferred to provide a different release, for example, manually, as proposed in a similar manner in the prior art.

FIGS. 4A-4D and 5A-5E show two variations of handles 21 and their different positions together with the shifts around the housing-mounted protrusion 29.

In the (more frequently occurring) use of the charging handle assembly for tensioning the weapon, the handle 21 acts via a recoil surface 34 of its outer contour (FIG. 4B) directly on a mating surface of the body 20 and thus relieves the pivot pin 23. For this purpose, the elongated hole must be sufficiently dimensioned toward the front in order to release the pivot pin.

Figures 3A, 3B:
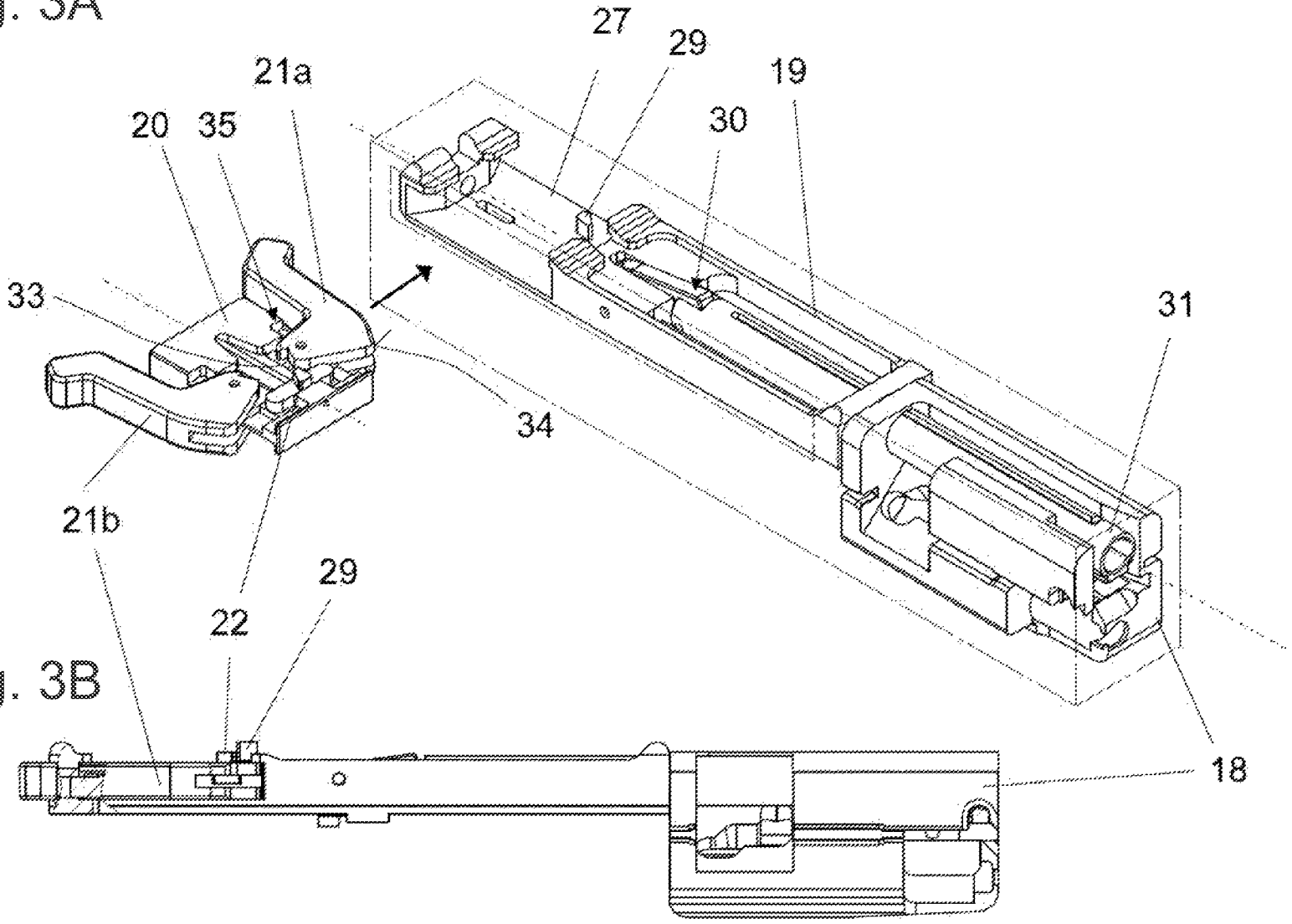
Figure 4A:
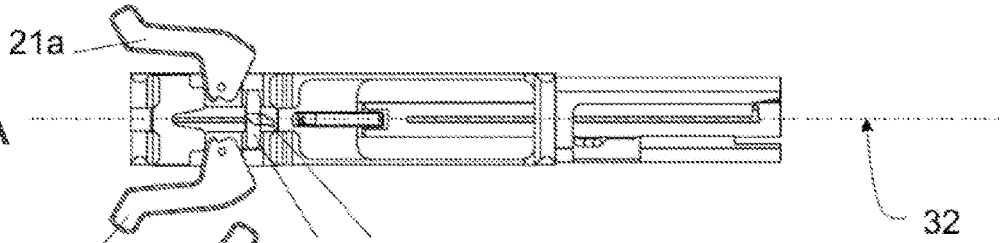
FIGS. 4A-4D depict a top view of the charging handle assembly of FIG. 2 while in different positions.
Figure 4B:
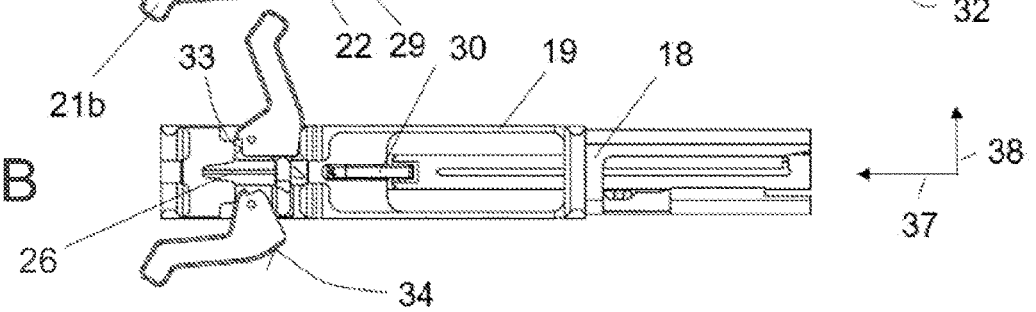
Figure 4C:
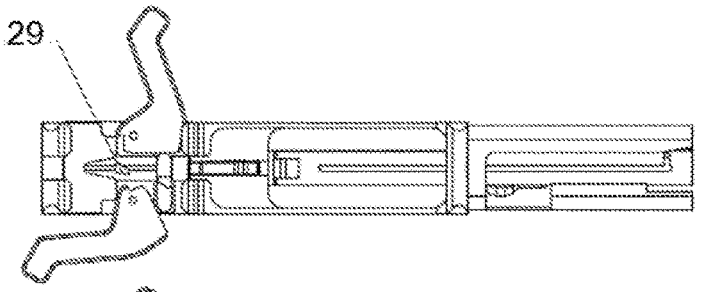
Figure 4D:
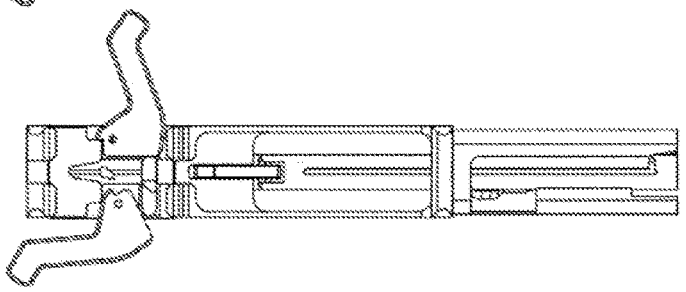
Figure 5A:
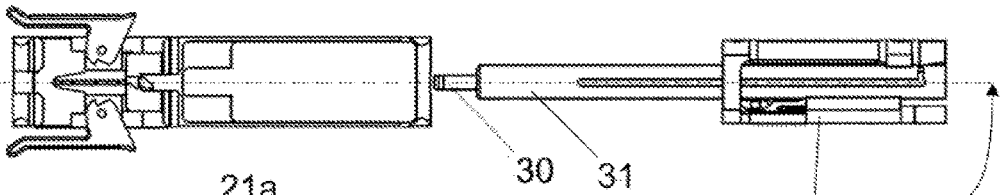
FIGS. 5A-5E show top views of a further possible embodiment of the disclosed charging handle assembly in additional different positions.
Figure 5B:
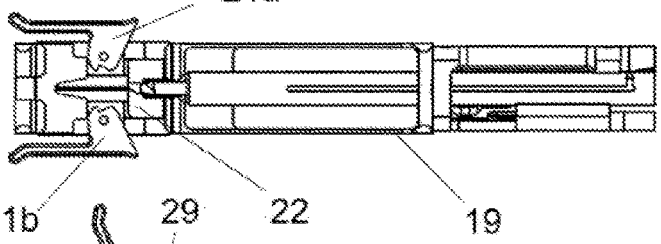
Figure 5C:
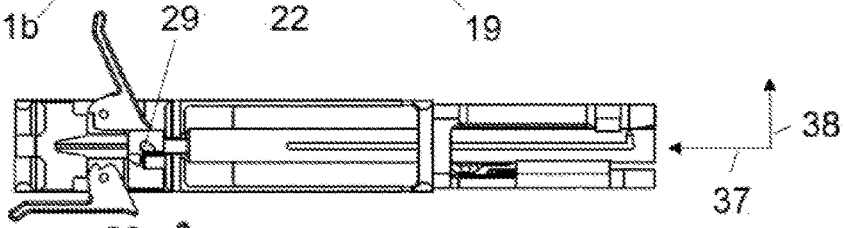
Figure 5D:
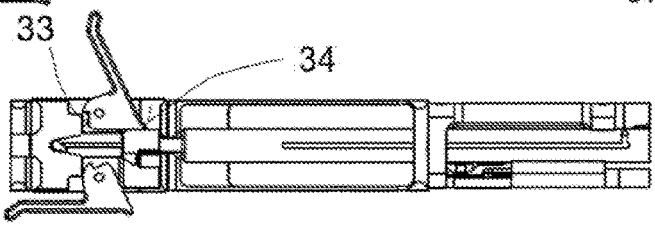
Figure 5E:
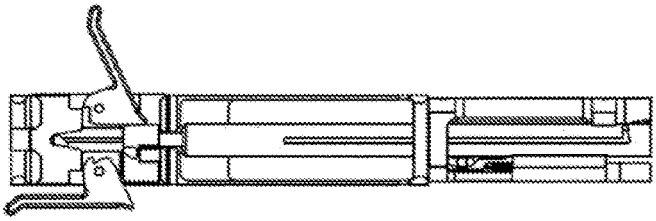

In the Figures, especially FIGS. 2 and 3 it can be seen that the slider body 20 is configured to be slidably mounted normally to the weapon median plane in the carriage 19. This can be done from either side of the firearm. In order to hold the slider body 20 in place, a locking mechanism 25, best seen in FIGS. 2 and 5, is foreseen on the slider body 20. The slider body 20 is thus removably fixed in the carriage 19 via this locking mechanism 25. The locking mechanism 25 is configured to interact with a locking recess 28 of the carriage 19. Though there exist many possibilities to construct such a locking mechanism 25, the presented example comprises a spring biased pin, which is suitable to the locking recess 28.

The charging handle assemblies of the present disclosure can be differently modified and designed; particularly the proportions of the individual components described can be adapted to the respective specifications of the weapon.

Terms such as "lower area" of a component or a device or, more generally, an object, refer to the lower half and particularly to the lower quarter of the total height, "bottom area" refers to the bottom quarter, and particularly an even smaller portion; while "center area" refers to the middle third of the total height (e.g., width-length). All these specifications have their general meaning applied to the intended position of the object considered. In the description and the claims, "essentially" refers to a deviation of up to 10% of the stated value, if it is physically possible, both downwards and upwards, otherwise only in the meaningful direction; for degree specifications (angle and temperature), ±10° shall apply.

For terms such as: "a spring", the word: "a" is to be regarded as an indefinite article or as a pronoun, unless the context indicates otherwise.

Unless specified otherwise, the terms: "combination" or "combinations" refers to all types of combinations, proceeding from two of the relevant components to a multiplicity, or also all, of such components; the term: "containing" also stands for: "consisting of." Specifications, such as: "more than three" also comprises and discloses every individual number greater than three.

The features and variations specified in the individual embodiments and examples can be freely combined with those of the other examples and embodiments and used without the obligatory inclusion of the other details of the respective embodiment or the respective example, particularly for characterizing the invention in the claims.

Finally, it can thus be noted: The present disclosure relates to a rifle with a weapon median plane 32, with a barrel 1 with a barrel bore axis 37, a gas drive 2, a bolt carrier 18, a recoil spring unit 31, and a charging handle assembly 8 arranged in front of the bolt carrier 18, wherein the charging handle assembly 8 has two handles 21*a, b* rotatable mounted about the pivot pins 23*a, b* on a slider body 20, said handles 21*a, b* being pushed about the pivot pins 23*a, b* into their rest position by at least one handle spring, characterized in that the slider body 20 is mounted on a carriage 19 which is arranged axially in front of the bolt carrier 18 and movable in the axial direction.

Further designs and embodiments relate to:

2. Rifle according to embodiment 1, characterized in that, in the carriage 19, a catch slider 22 is slidably mounted normal to the weapon median plane 32, said catch slider 22 being pushed by a catch slider spring 26 into a position symmetrical to the weapon median plane 32, in which it is located axially in front of a gun-mounted catch 29.

3. Rifle according to embodiment 2, characterized in that, upon pivoting a handle 21*a,b*, the catch slider 22 is shifted, due to its contour, against the force of the catch slider spring 26 from its rest position, placing it next to the catch 29.

4. Rifle according to one of the embodiments 1 to 3, characterized in that, on the carriage 19 or the catch slider 22, a hook is preferably mounted which is pivotable about an axis running normally to the weapon median plane 32, and which, under the effect of a hooked spring, is pushed to mesh with the recoil spring unit 31 or the bolt carrier 18.

5. Rifle according to one of the embodiments 1 to 3, characterized in that, on the recoil spring unit 31 or on the bolt carrier 18, a hook is pivotable mounted which, under the effect of a hooked spring, is pushed to mesh with the carriage 19 or the catch slider 22.

6. Rifle according to one of the embodiments 4 or 5, characterized in that, in the foremost position of the carriage 19, the hook is pivoted out of the mesh by a weapon-mounted control edge 29 against the force of the hooked spring.

7. Rifle according to one of the previous embodiments, characterized in that the pivot pins 23*a, b* are guided in elongated holes 36 of the handles 21*a, b*, which, in the unfolded position of the handles 21*a,b*, run parallel to the barrel bore axis 37.

8. Rifle according to embodiment 7, characterized in that, in their unfolded position, the handles 21*a,b* are pushed to the rear parallel to the barrel bore axis 37 by the at least one handle spring.

9. Rifle according to embodiment 7, characterized in that, in the unfolded position of the handle 21*a, b*, advanced against the force of the at least one handle spring, a section of its contour bears against a mating contour of the slider body 20, thus preventing the folding of the handle 21*a,b* into the rest position.

10. Rifle according to one of the embodiments 7 to 9, characterized in that, in the unfolded position of the handle 21*a,b*, in which it is pushed to the rear, a section of its contour, the recoil surface 34, bears against a mating contour of the slider body 20 or the carriage 19, thus transferring the tensioning force.

11. Rifle according to one of the previous embodiments characterized in that, the slider body (20) is slidably mounted normally to the weapon median plane in the carriage (19). 12. Carbine according to claim 11 characterized in that the slider body (20) is removably fixed in the carriage (19) via a locking mechanism (25), the locking mechanism (25) being configured to interact with a locking recess (28) of the carriage (19).

LIST OF REFERENCE SIGNS

| | |
|---|---|
| 1 | Barrel |
| 2 | Gas drive |
| 3 | Locking sleeve |
| 4 | Upper housing or upper |
| 5 | Carrier module |
| 6 | Guide element(s) |
| 7 | Locking unit |
| 8 | Charging handle assembly |
| 9 | Front shaft |
| 10 | Lower housing or lower |
| 11 | Magazine holder |
| 12 | Trigger unit |
| 13 | Handle |
| 14 | Lock catch |
| 15 | Central locking system |
| 16 | Magazine |
| 17 | Shaft |
| 18 | Bolt carrier |
| 19 | Carriage |
| 20 | Charging handle assembly body (slider body) |
| 21 | a, b (Charging) handle |
| 22 | Catch slider |
| 23 | a, b Pivot pins, pins |
| 24 | a, b Reset device |
| 25 | Locking mechanism |
| 26 | Catch slider spring |
| 27 | Charging handle assembly seat |
| 28 | Locking recess |
| 29 | Control element |
| 30 | Recoil spring entraining device |
| 31 | Recoil spring unit |
| 32 | Weapon median plane |
| 33 | Advance surface |
| 34 | Recoil surface |
| 35 | Mating surface |
| 36 | Elongated hole |
| 37 | (Direction of the) barrel bore axis |
| 38 | Transverse direction |
| 39 | Vertical direction |
| 40 | Contact area |
| 41 | Arrow |

The invention claimed is:

1. A rifle having a weapon median plane, the rifle comprising a barrel with a barrel bore axis, a gas drive, a bolt carrier, a recoil spring unit, and a charging handle assembly arranged in front of the bolt carrier;

wherein the charging handle assembly has two handles pivotally mounted on a slider body, each handle being pivotally mounted on a pivot pin, and each handle being urged to pivot on its pivot pin into a rest position by at least one handle spring;

the slider body is mounted on a carriage that is arranged axially in front of the bolt carrier, and the slider body is movable in the axial direction; and each of the two handles is mounted to its pivot pin by an elongated hole, such that when each handle is in an unfolded position the elongated hole runs parallel to the barrel bore axis, and the handles can be guided along the pivot pins.

2. The rifle according to claim 1, wherein the carriage includes a catch slider that is slidably mounted normal to the weapon median plane, the catch slide being urged by a catch slider spring into a position symmetrical to the weapon median plane in which the catch slide is disposed axially in front of a gun-mounted catch.

3. The rifle according to claim 2, wherein the catch slider includes a contour, and the rifle is configured so that upon pivoting a handle the catch slider is shifted by the catch slider contour against the urging of the catch slider spring from a rest position to a position adjacent to the gun-mounted catch.

4. The rifle according to claim 2, wherein a hook is mounted on the carriage or the catch slider, the hook being pivotable about an axis running normally to the weapon median plane, and under the effect of a hooked spring the hook is urged to mesh with the recoil spring unit or the bolt carrier.

5. The rifle according to claim 4, when the carriage is in its foremost position, the hook is pivoted out of the mesh against the force of the hooked spring by a weapon-mounted control edge.

6. The rifle according to claim 2, wherein a hook is pivotably mounted on the recoil spring unit or the bolt carrier, and under the urging of a hooked spring the hook pushed to mesh with the carriage or the catch slider.

7. The rifle according to claim 6, when the carriage is in its foremost position, the hook is pivoted out of the mesh against the force of the hooked spring by a weapon-mounted control edge.

8. The rifle according to claim 1, wherein when the handles are in their unfolded position, the handles are urged towards the rear parallel to the barrel bore axis by the at least one handle spring.

9. The rifle according to claim 1, wherein when each handle is in its unfolded position and advanced against the force of the at least one handle spring, a section of a contour of the handle bears against a mating contour of the slider body, thereby preventing the handle from folding into its rest position.

10. The rifle according to claim 1, wherein when each handle is in its unfolded position and pushed to the rear, a section of a contour of the handle that is a recoil surface bears against a mating contour of the slider body or the carriage, thereby transferring a tensioning force.

11. The rifle according to claim 1, wherein the slider body is slidably mounted normally to the weapon median plane in the carriage.

12. The rifle according to claim 11, wherein the slider body is removably fixed in the carriage by a locking mechanism, and the locking mechanism is configured to interact with a locking recess of the carriage.

* * * * *